US010869528B2

(12) United States Patent
Goldman

(10) Patent No.: US 10,869,528 B2
(45) Date of Patent: Dec. 22, 2020

(54) CONVERTIBLE BAG

(71) Applicant: Alison Goldman, San Francisco, CA (US)

(72) Inventor: Alison Goldman, San Francisco, CA (US)

( * ) Notice: Subject to any disclaimer, the term of this patent is extended or adjusted under 35 U.S.C. 154(b) by 0 days.

(21) Appl. No.: 16/390,457

(22) Filed: Apr. 22, 2019

(65) Prior Publication Data

US 2019/0320771 A1 Oct. 24, 2019

Related U.S. Application Data

(60) Provisional application No. 62/661,006, filed on Apr. 22, 2018.

(51) Int. Cl.

| | |
|---|---|
| ***A45C 9/00*** | (2006.01) |
| ***A45C 13/10*** | (2006.01) |
| ***A45C 3/00*** | (2006.01) |

(52) U.S. Cl.

CPC ..... *A45C 9/00* (2013.01); *A45C 3/001* (2013.01); *A45C 13/1069* (2013.01)

(58) Field of Classification Search

CPC ..... A45C 9/00; A45C 3/001; A45C 13/1069

USPC ..... 383/2, 4

See application file for complete search history.

(56) References Cited

U.S. PATENT DOCUMENTS

| | | | | |
|---|---|---|---|---|
| 185,372 | A * | 12/1876 | Watts | A45C 9/00 190/1 |
| 2,502,486 | A * | 4/1950 | Savrin | A45C 9/00 190/1 |
| 4,792,024 | A * | 12/1988 | Morton | A45C 9/00 190/1 |
| 8,627,520 | B1 * | 1/2014 | Morton | A47D 9/005 190/2 |
| 2005/0210594 | A1 * | 9/2005 | Pistiolis | A47D 13/02 5/655 |
| 2007/0163689 | A1 * | 7/2007 | Pace | A45C 3/08 150/105 |
| 2010/0213019 | A1 * | 8/2010 | Paulk | A45C 7/0059 190/103 |
| 2015/0083764 | A1 * | 3/2015 | Houston | A45F 4/02 224/156 |
| 2016/0242519 | A1 * | 8/2016 | Calman | A45C 9/00 |
| 2018/0008023 | A1 * | 1/2018 | Morrow | A45C 13/005 |

* cited by examiner

*Primary Examiner* — Jes F Pascua
(74) *Attorney, Agent, or Firm* — Perkins Coie LLP

(57) ABSTRACT

A convertible bag is provided to include a bottom surface including a central portion and two movable portions differently positioned with respect to the central portion depending on whether the bag is in a folded state or in an unfolded state; a first side portion foldable in response to a force applied to the bag, the first side portion having first magnets attracted to each other to facilitate maintaining the bag in the folded state; a second side portion foldable in response to the force applied to the bag, the second side portion having second magnets attracted to each other to facilitate maintaining the bag in the folded state and the second side of the bottom surface opposite to the first side of the bottom surface; and a third and fourth side portions that are respectively located at a third side and a fourth side of the bottom surface.

13 Claims, 5 Drawing Sheets

CONVERTIBLE BAG

CROSS-REFERENCE TO RELATED APPLICATIONS

This patent document claims priorities to and benefits of U.S. Provisional Patent Application No. 62/661,006 entitled "Convertible Bag to Tray" filed on Apr. 22, 2018. The entire content of the aforementioned patent application is incorporated by reference as part of the disclosure of this patent document.

TECHNICAL FIELD

This patent document generally relates to devices and techniques for a bag whose shape is changeable.

BACKGROUND

Hand carrying storages are used almost every day. There are various hand carrying storages depending on sizes, features, designs, occasions, etc. The hand carrying storages have been considered as a fashion item and so its aesthetic aspect is an important factor to choose a bag. In addition, as multiple items are carried in the hand carrying storages, the function to organize the items carried by the bag are also considered as another important factor to choose the bag.

SUMMARY

This document relates to devices and techniques for a convertible bag whose shape is changeable. In some implementations, the bag is convertible between a folded state and an unfolded state. In the folded state, the bag has a size more compact as compared to that in the unfolded state and thus easier to carry. In the unfolded state, the bag has an opening area exposed to outside and having a size sufficient to allow a user to easily find an item in the bag. The bag is designed to allow the use to easily convert the bag between the folded state and the unfolded state.

In one aspect, a bag is provided to comprise: a bottom surface including a central portion and two movable portions on opposite sides of the central portion, the two movable portions differently positioned with respect to the central portion depending on whether the bag is in a folded state or in an unfolded state; a first side portion located at a first side of the bottom surface and foldable in response to a force applied to the bag, the first side portion having first magnets attracted to each other to facilitate maintaining the bag in the folded state; a second side portion located at a second side of the bottom surface and foldable in response to the force applied to the bag, the second side portion having second magnets attracted to each other to facilitate maintaining the bag in the folded state and the second side of the bottom surface opposite to the first side of the bottom surface; a third side portion located at a third side of the bottom surface and connecting the first side portion and the second side portion; a fourth side portion located at a fourth side of the bottom surface and connecting the first side portion and the second side portion, the fourth side of the bottom surface opposite to the third side of the bottom surface.

In some implementations, the two movable portions move between a first state in which the two movable portions are located in a same plane as the central portion and a second state in which the two movable portions are located in a different plane from the central portion. In some implementations, wherein the first magnets include a center magnet and two other magnets located on different sides of the magnet, the two other magnets overlapping each other to maintain the bag in the folded state. In some implementations, the second magnets include a center magnet and two other magnets located on different sides of the magnet, the two other magnets overlapping each other to maintain the bag in the folded state. In some implementations, the bottom surface of the bag is exposed to outside when the bag is in the unfolded state and a size of the exposed bottom surface is greater than a size of an opening when the bag is in the folded state. In some implementations, the force is applied to the bag through at least two of the first side portion, the second side portion, the third side portion, or the fourth side portion. In some implementations, the third side portion and the fourth side portion are positioned above the central portion of the bottom surface when the bag is in the folded state. In some implementations, the third side portion and the fourth side portion form a lid to cover an internal space of the bag when the bag is in the folded state. In some implementations, the bag further includes a handle attached to the lid. In some implementations, the bag further comprises a metal, a magnet, or a strip on the lid. In some implementations, each of the first side portion and the second side portion includes two layers of a fabric and the first magnets and the second magnets are disposed between the two layers of the fabric.

In another aspect, a method for converting a bag to an unfolded state is provided. The method may comprise: receiving a force in a bag having a bottom surface and a side structure formed along sides of the bottom surface, the bottom surface having a central portion and foldable portion on opposite sides of the central portion; and converting a shape of the bag, in response to the force, between an unfolded state and a folded state, wherein the converting the shape of the bag includes: moving the foldable portions of the bottom surface from a first position to a second position different from the first position; and overlapping magnets disposed at the side structure by using magnetizations of magnets or separating the magnets that overlap one another.

In some implementations, wherein the foldable portions of the bottom surface are in a same plane as the central portion when the bag is in the unfolded state and are in a different plane from the central portion when the bag is in the folded state. In some implementations, a portion of the side structure is positioned above the central portion of the bottom surface when the bag is in the folded state. In some implementations, the side structure includes two layers of a fabric and the magnets are disposed between the two layers of the fabric. In some implementations, the converting the shape of the bag further includes forming a lid with a portion of the side structure, the lid covering an internal space of the bag. In some implementations, the bag includes a handle attached to the lid. In some implementations, the bag further includes a metal, a magnet, or a strip on the lid.

The above and other aspects and their implementations are described in greater detail in the drawings, the descriptions, and the claims.

DETAILED DESCRIPTION

The disclosed technology provides implementations and examples of a convertible bag. Some implementations of the disclosed technology suggest converting a bag between a folded state and an unfolded state. In the folded state, the bag has a relatively compact size as compared to the unfolded state and thus easier to carry. In the unfolded state, the bag has an opening area exposed to outside and having a size sufficient to allow a user to easily find an item in the bag.

With conventional bags, there are some limitations to find a specific item since the conventional bags have an internal space reachable through a limited opening area of the bag. This inconvenience becomes more problem when the number of items carried in the bag increases. For example, there are various items carried in the bag, for example, makeup products, pens, pencils, toiletries, or even clothes, and people are often digging around to find the specific item they need. To address this inconvenience and provide an easier way to carry and find an item in a bag, the disclosed technology provides a bag convertible between a folded state and an unfolded state. This convertible bag can be converted into the unfolded state. The fully unfolded bag creates a tray-like structure with side structures to keep the contents contained. In the unfolded state, the bag has an opening exposed outside and reachable from many directions. This enables an easier access to the contents inside the bag and an ability to more quickly locate a desired item in the bag. The opening of the bag in the unfolded state has a greater size than that of the opening of the bag in the folded state. With this structure, the convertible bag allows to avoid wasting time in shuffling around in a bag or resorting to taking everything out from the bag. In some implementations, the bag has a side surface which is foldable to allow the bag to fold out flat. The bag conveniently folds back up with a quick magnetic closing mechanism to retake its original bag form.

Figure 1:
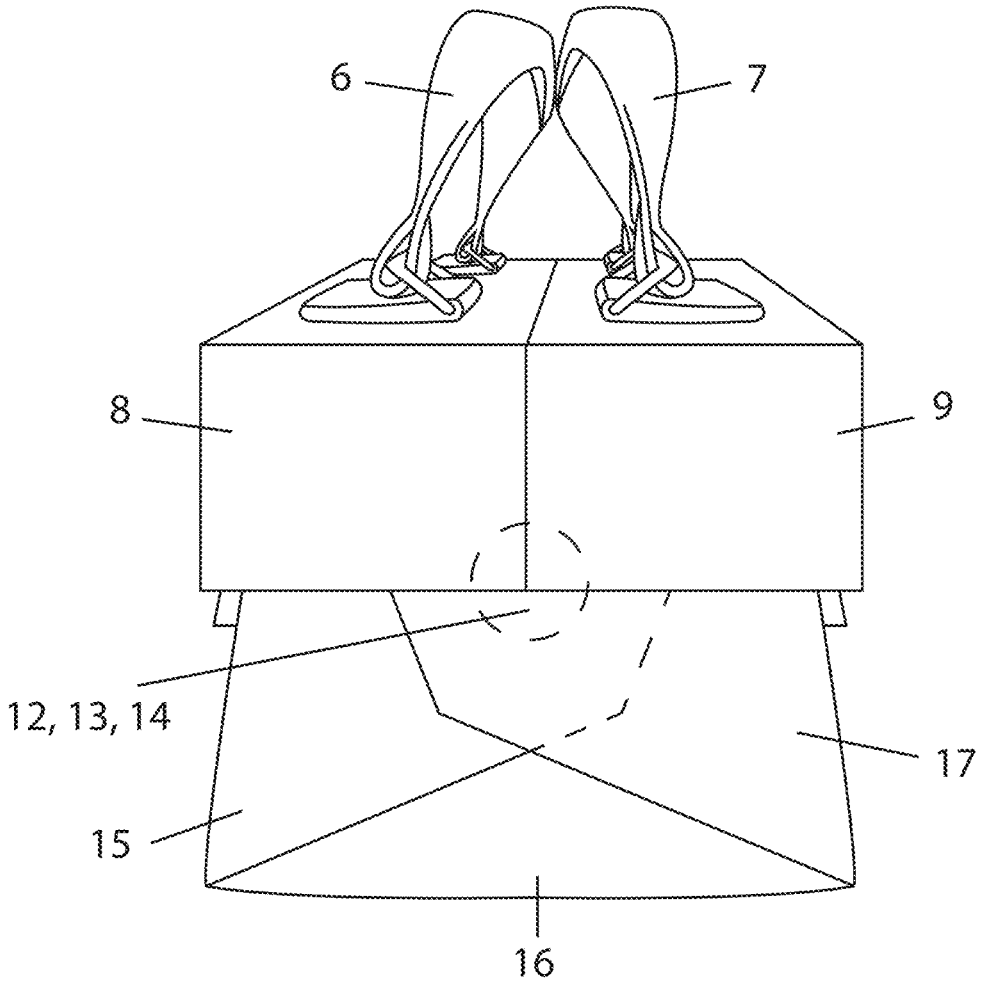
FIG. 1 shows a view showing an example of a convertible bag which is in a folded state based on some implementations of the disclosed technology.

FIG. 1 shows a view showing an example of a convertible bag which is in a folded state based on some implementations of the disclosed technology. The bag in FIG. 1 is in the folded state. As shown in FIG. 1, the side surface of the bag includes the portions 15, 16, and 17 and the lid of the bag includes portions 8 and 9. In the folded state, the lid including the portions 8 and 9 is located over the side surface including the portions 15, 16, and 17 to close the bag. In the folded state, the portions 8 and 9 contact to each other around a middle of the upper part. When the bag is shut or closed, as depicted in FIG. 1, the bag is completely closed with the portions 8 and 9 which function as the lid to securely contain the contents. In some implementations, the portions 8 and 9 of the bag remain being held together by the side surface including magnets based on the magnetizations of the magnets. As will be further explained, the portions 15, 16, and 17 form the side surface and each of the portions 15 and 17 includes magnets 12, 13, and 14 at different positions of the side surface. The magnets are attracted to one another due to magnetizations of the magnets when the portions 8 and 9 are folded up, thereby facilitating maintaining the bag in the folded state. Although FIG. 1 shows one side surface including portions 15, 16, and 17, the bag has an opposite side surface including portions corresponding to the portions 15, 16, and 17.

In FIG. 1, the dotted circle shows the three stacked magnets 12, 13, and 14 that are overlapping one another. In some implementations, the portions 15 and 17 include two layers of fabric and the magnets 12, 13, and 14 may be disposed between the two layers of fabrics and thus not visible. One of the magnets 13 is located on the portion 16 (see FIGS. 3 and 4) which is at the middle of the side surface including portions 15, 16, 17. Other two magnets 13 and 14 are located on portions 15 and 17 which lie on the portion to complete the folded state. Although it is explained that the side surface includes three magnets 12, 13, 14 disposed on portions 15, 16, 17, respectively, the number of magnets and the number of portions is not limited to three and other implementations are also possible. In some implementations, the bag may have two exterior handles 6 and 7 for an easy carrying of the bag. The user can open the bag by using the handles 6 and 7 and the two portions 8 and 9 can be separated as shown in FIG. 3 to convert the bag into the unfolded state.

Figure 2:
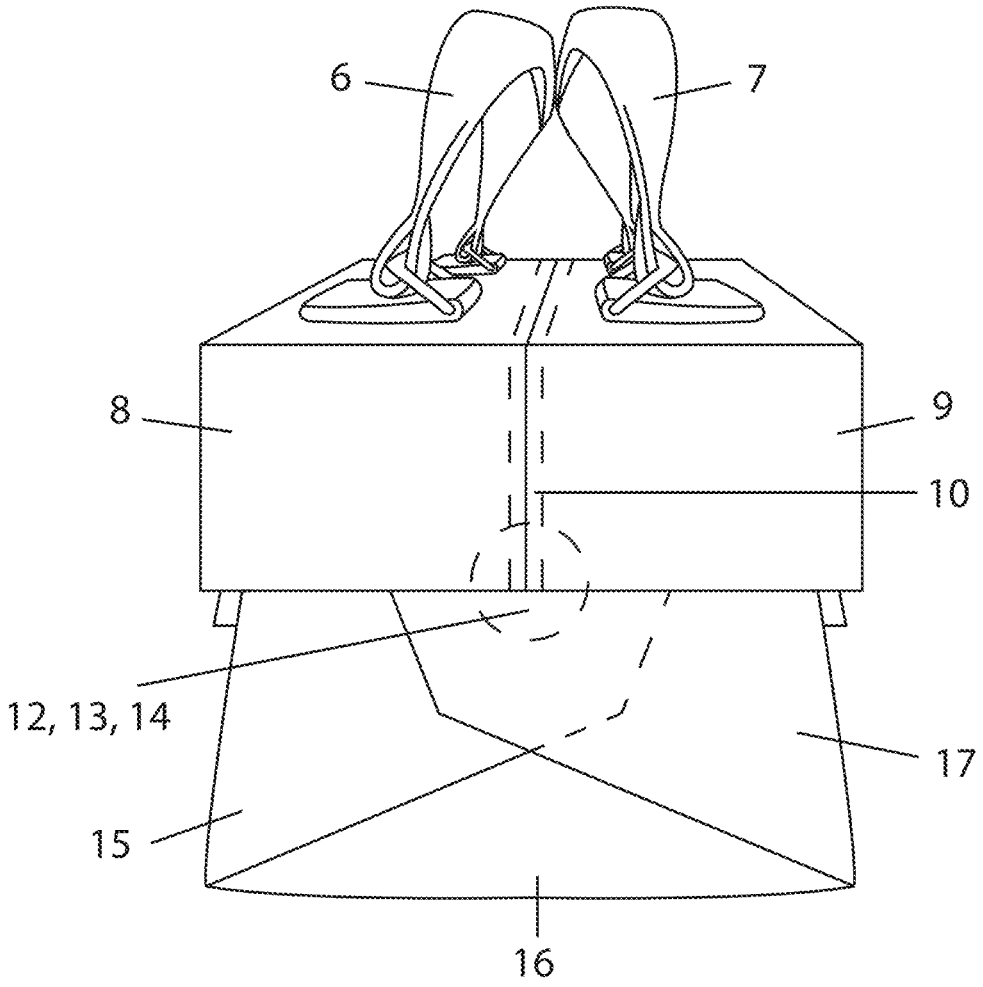
FIG. 2 shows a view showing another example of a convertible bag which is in a folded state based on some implementations of the disclosed technology.

FIG. 2 shows a view showing another example of a convertible bag which is in a folded state based on some implementations of the disclosed technology. The bag in FIG. 2 further includes the metal strip 10 that is arranged along a middle line of the lid. In some implementations, the metal strip 10 can be replaced with small pieces of a metal or an additional magnet to adhere to the portions 8 and 9. In some implementations, if the lid includes material that is sufficiently sturdy to keep the portions 8 and 9 adhered together, the bag can omit any additional element around the middle line of the lid.

Figure 3:
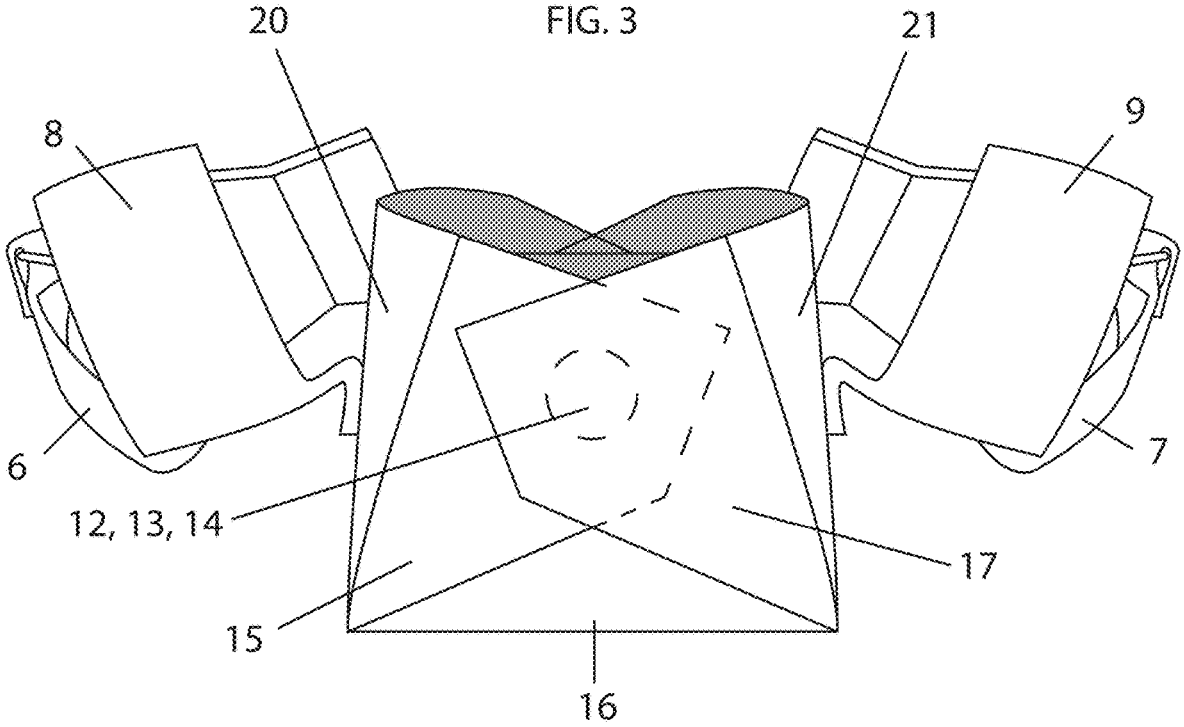
FIG. 3 shows a view showing an example of a convertible bag which is in a middle of conversion based on some implementations of the disclosed technology.

FIG. 3 shows a view showing an example of a convertible bag which is in a middle of conversion based on some implementations of the disclosed technology. The conversion of the bag into the unfolded state is achieved by separating the portions 8 and 9 from each other. This separation can be done in multiple ways, for example, by applying a force to the bag. In some implementations, the force can be applied to the sides 20 and 21 or the force can be applied to the portions 8 and 9. Such force can have the sides 20 and 21 of the bag to be unhinged and pushed outward. In FIG. 3, when the portions 8 and 9 forming the lid are separated from each other, the bag is open and has an opening area exposed to outside. The opening area is surrounded by the portions 15, 16, 17, 20, 21 which from a sidewall of the bag, Some of the portions 15, 16, 17, 20, 21 which form the sidewall of the bag are still held together by the magnets 12, 13, 14. When the bag is converted into an unfolded state as discussed with regard to FIG. 4, the portions 15, 16, 17 will form a tray side structure and portions 20 and 21 will form a tray bottom surface. When the bag is converted into the unfolded state, the portion 16 becomes the center of the tray side wall and the portions 15 and 17 are located on opposite sides of the portion 16 to provide the tray side wall.

Figure 4:
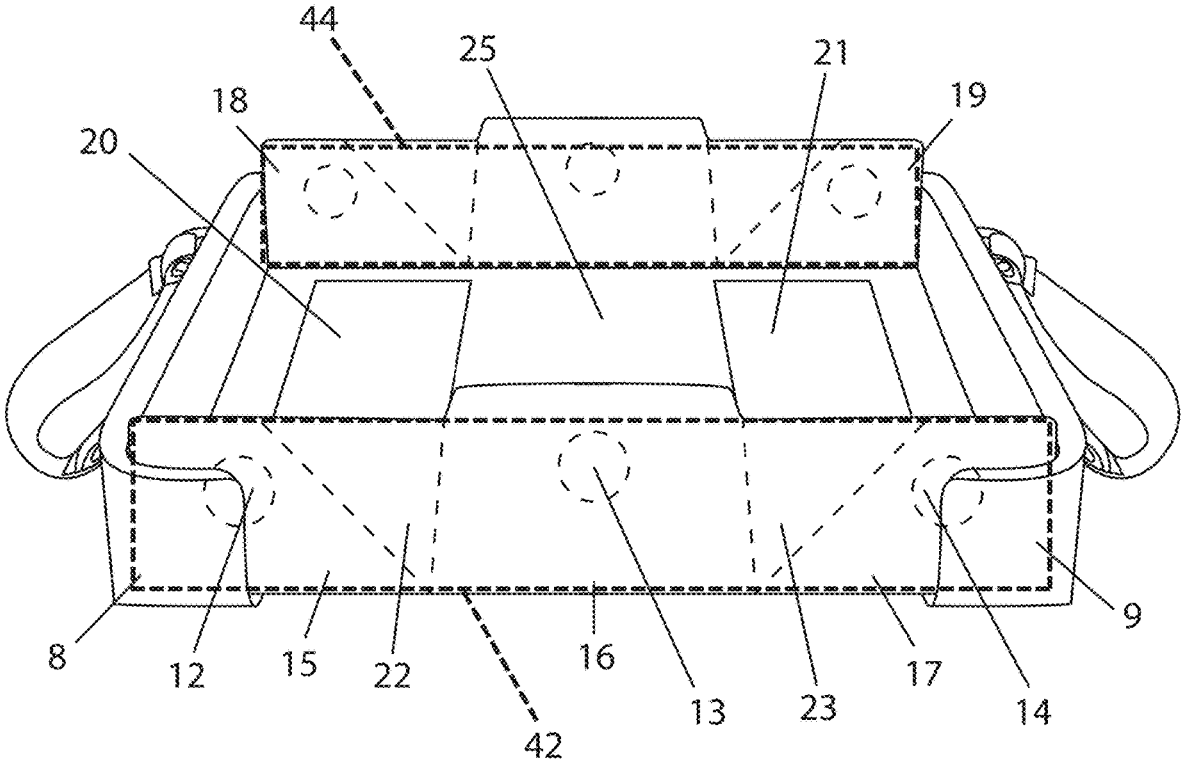
FIG. 4 shows a perspective view showing an example of a convertible bag which is in an unfolded state based on some implementations of the disclosed technology.

FIG. 4 shows a perspective view showing an example of a convertible bag which is in an unfolded state based on some implementations of the disclosed technology. Referring to FIG. 4, the bag has a tray-like structure including a rectangular base and a tray side structure formed along the rectangular base. The side structure includes first to fourth side surfaces, the first side surface 42 including the portions 15, 16, 17, the second surface 44 opposite to the first side surface, the third side surface including the portion 8, and the fourth side surface including the portion 9. FIG. 4 shows that each of the portions 8 and 9 is extended to overlap with the edges of the first side surface 42 and the second side surface 44. In FIG. 4, it is shown that the edges 18 and 19 of the second side surfaces 44 tuck inside the portions 8 and 9. As already discussed with regard to FIG. 1, the portions 8 and 9 can function as the lid when the bag is in the folded state where the portions 8 and 9 are arranged to contact to each other. In FIG. 4, the portions 8 and 9 form a part of the tray side structure.

In the unfolded state, the magnets are separated from one another and located at different positions. In FIG. 4, the first side surface 42 includes magnets 12, 13, 14 that are disposed at different portions of the first side surface 42. The second side surface 44 includes magnets (see the dotted circles) that are disposed at different portions of the second side surface 44. Although FIG. 4 shows that each of the first and second side surfaces includes three magnets, the number of magnets is not limited to three and other implementations are also possible. As discussed with reference to FIG. 1, the magnets on different portions of each of the first and second side surfaces are attracted to one another based on the magnetizations of the magnets to allow the bag to be maintained in the folded state. In FIG. 4, the magnets are separated from one another by applying an external force to convert the bag to the unfolded state.

A shown in FIG. 4, the bag in the unfolded state has an opening exposed to outside. Such opening has a greater size than that of the opening when the bag is in the folded state (see FIG. 3). The opening is surrounded by the tray side structure along an outside edge of the bottom surface of the bag. The bottom surface and the tray side structure can form any angle with respect to each other depending on designs or needs as long as the items in the bag can be contained in the bag. In some implementations, the first side surface 42 including portions 15, 16, and 17 may include material between two layers of fabric to increase stability and provide structural integrity. For example, the material of the first side surface 42 has rigidity sufficient enough to keep the items contained inside the bag. Portions 22 and 23 include two layers of fabric, without additional structural material, allowing the bag to be folded along the dotted lines as illustrated in FIG. 4. Thus, in response to a force applied to the bag, the portions 15 and 17, which include the portions 22 and 23, respectively, can be folded to convert the bag into the folded state. The second side surface 44 also includes material between two layers of fabric. For example, the material of the second side surface 44 has rigidity sufficient enough to keep the items contained inside the bag. The second side surface has portions corresponding to portions 15, 17, 22, and 23 to allow the bag to be folded up.

Figure 5:
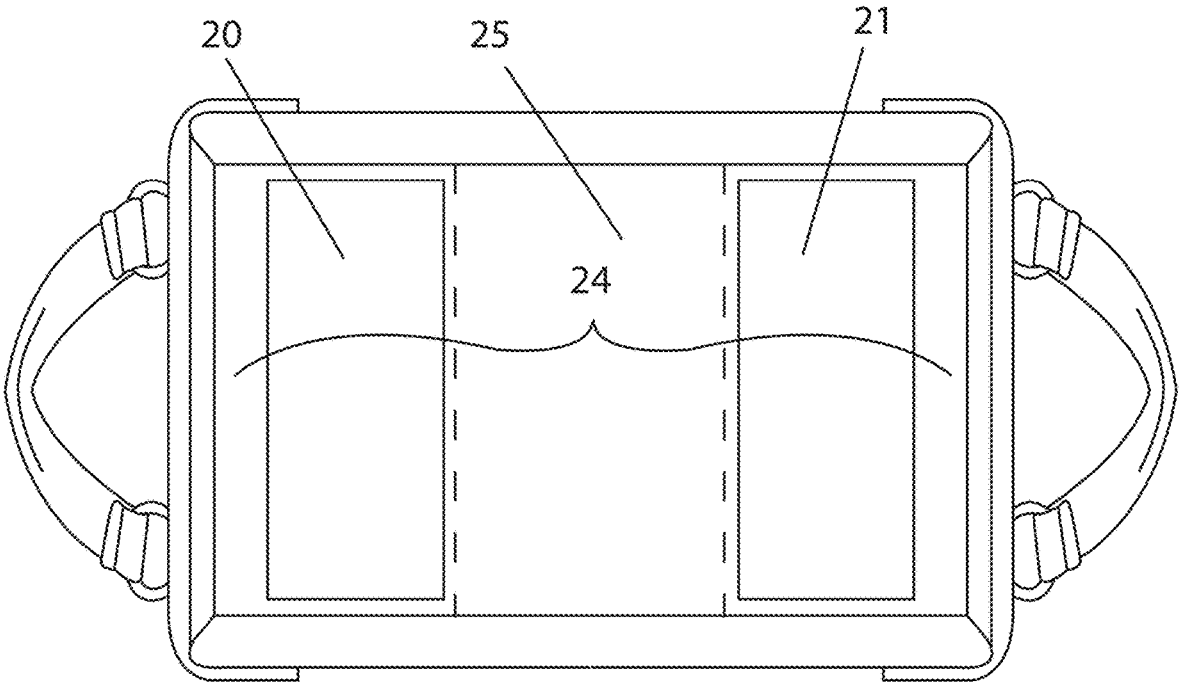
FIG. 5 shows a plan view of an example of a convertible bag which is in an unfolded state based on some implementations of the disclosed technology.

FIG. 5 shows a plan view of an example of a convertible bag which is in an unfolded state based on some implementations of the disclosed technology. The interior base 24 of the tray on FIG. 4 includes a center portion 25 and movable portions 20 and 21 arranged on opposite sides of the center portion 25. In the unfolded state, the movable portions 20 and 21 are in a same plane as the central portion 25. In the folded state, the movable portions 20 and 21 form the sidewall of the bag as discussed with reference to FIG. 3. Thus, in the folded state, the movable portions 20 and 21 are not in the same plane as the central portion 25.

The bag may contain various organizational elements such as mesh pockets, elastic loops, or zipper pockets. To convert the bag into the bag shape from the tray shape, a force can be applied to the bag such that the movable portions 20 and 21 stand upright or inclined with respect to the central portion, thereby forming the sides of the bag. In addition, the force applied to the bag can allow the portions of the first and second side surfaces to be folded and stayed as folded based on the magnetizations of the magnets.

The bag disclosed in this patent document can be converted between the bag shape and the tray shape with a simple structure. Thus, there is very little or no additional costs incurred to allow the conversion of the bag. The interior and/or exterior fabric of the bag can vary depending on the intended use of the bag. The durable bag can be provided for long term use. The bag also has a wide variety of uses. Although some implementations are discussed above, the shapes and sizes of the bag can be modified in various manners.

It is intended that the specification, together with the drawings, be considered exemplary only, where exemplary means an example and, unless otherwise stated, does not imply an ideal or a preferred embodiment. As used herein, the use of "or" is intended to include "and/or", unless the context clearly indicates otherwise.

While this document contains many specifics, these should not be construed as limitations on the scope of an invention that is claimed or of what may be claimed, but rather as descriptions of features specific to particular embodiments. Certain features that are described in this document in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or a variation of a sub-combination. Similarly, while operations are depicted in the drawings in a particular order, this should not be understood as requiring that such operations be performed in the particular order shown or in sequential order, or that all illustrated operations be performed, to achieve desirable results.

Only a few implementations and examples are described and other implementations, enhancements and variations can be made based on what is described and illustrated in this disclosure.

What is claimed is:

1. A bag, comprising:

a bottom surface including a central portion and two movable portions on opposite sides of the central portion, the two movable portions differently positioned with respect to the central portion depending on whether the bag is in a folded state or in an unfolded state;

a first side portion located at a first side of the bottom surface and foldable in response to a force applied to the bag, the first side portion having first magnets located at different portions of the first side portion and attracted to each other to facilitate maintaining the bag in the folded state;

a second side portion located at a second side of the bottom surface and foldable in response to the force applied to the bag, the second side portion having second magnets located at different portions of the second side portion and attracted to each other to facilitate maintaining the bag in the folded state and the second side of the bottom surface opposite to the first side of the bottom surface;

a third side portion located at a third side of the bottom surface and connecting the first side portion and the second side portion; and a fourth side portion located at a fourth side of the bottom surface and connecting the first side portion and the second side portion, the fourth side of the bottom surface opposite to the third side of the bottom surface, wherein the third side portion and the fourth side portion are configured to move between i) a closed bag state in which the third side portion and the fourth side portion are in contact to each other and ii) an open bag state in which the third side portion and the fourth side portion are separated from each other, and wherein the first magnets and the second magnets are configured to be attracted to each other to maintain the bag in the folded state while the third side portion and the fourth side portion are in the open bag state.

2. The bag of claim 1, wherein the two movable portions move between a first state in which the two movable portions are located in a same plane as the central portion and a second state in which the two movable portions are located in a different plane from the central portion.

3. The bag of claim 1, wherein the first magnets include a center magnet and two other magnets located on different sides of the magnet, the two other magnets overlapping each other to maintain the closed bag state and the open bag state.

4. The bag of claim 1, wherein the second magnets include a center magnet and two other magnets located on different sides of the magnet, the two other magnets overlapping each other to maintain the closed bag state and the open bag state.

5. The bag of claim 1, wherein when the bag is in the unfolded state, the bottom surface of the bag is exposed to outside and an exposed bottom surface has a greater size as compared than that when the bag is in the folded state.

6. The bag of claim 1, wherein the force is applied to the bag through at least two of the first side portion, the second side portion, the third side portion, or the fourth side portion.

7. The bag of claim 1, wherein the third side portion and the fourth side portion are positioned above the central portion of the bottom surface when the bag is in the folded state.

8. The bag of claim 1, wherein the third side portion and the fourth side portion form a lid to cover an internal space of the bag when the bag is in the folded state.

9. The bag of claim 8, further including a handle attached to the lid.

10. The bag of claim 8, further comprising a metal, a magnet, or a strip on the lid.

11. The bag of claim 1, wherein each of the first side portion and the second side portion includes two layers of a fabric and the first magnets and the second magnets are disposed between the two layers of the fabric.

12. The bag of claim 8, wherein the third side portion and the fourth side portion are in contact to each other around a middle portion of the lid.

13. The bag of claim 1, wherein the bag in the open bag state has a first opening exposed outside and the bag in the unfolded state has a second opening having a greater size than that of the first opening.

* * * * *